US006252233B1

(12) United States Patent
Good

(10) Patent No.: US 6,252,233 B1
(45) Date of Patent: Jun. 26, 2001

(54) INSTANTANEOUS BALANCE CONTROL SCHEME FOR IONIZER

(75) Inventor: Timothy A. Good, Royersford, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/347,671

(22) Filed: Jul. 6, 1999

Related U.S. Application Data

(60) Provisional application No. 60/101,019, filed on Sep. 18, 1998.

(51) Int. Cl.[7] ..... H01J 27/00

(52) U.S. Cl. ..... 250/423 R; 361/213; 361/235

(58) Field of Search ..... 361/213, 235; 250/423 R

(56) References Cited

U.S. PATENT DOCUMENTS

| | | |
|---|---|---|
| 2,264,495 | 12/1941 | Wilner . |
| 2,879,395 | 3/1959 | Walkup . |
| 3,711,743 | 1/1973 | Bolasny . |
| 3,714,531 | 1/1973 | Takahashi . |
| 3,936,698 | 2/1976 | Meyer . |
| 4,092,543 | 5/1978 | Levy . |
| 4,423,462 | 12/1983 | Antonevich . |
| 4,435,195 | 3/1984 | Testone . |
| 4,476,514 | 10/1984 | Mykkanen . |
| 4,477,263 | 10/1984 | Shaver et al. . |
| 4,528,612 | 7/1985 | Spengler . |
| 4,542,434 | 9/1985 | Gehlke et al. . |
| 4,630,167 | 12/1986 | Huggins . |
| 4,642,728 | 2/1987 | Unger . |
| 4,740,862 | 4/1988 | Halleck . |
| 4,757,421 | 7/1988 | Mykkanen . |
| 4,757,422 | 7/1988 | Bossard et al. . |
| 4,785,248 | 11/1988 | Mykkanen et al. . |
| 4,809,127 | 2/1989 | Steinman et al. . |
| 4,872,083 | 10/1989 | Blitshteyn . |
| 4,878,149 | 10/1989 | Stiehl et al. . |

(List continued on next page.)

OTHER PUBLICATIONS

Ionization and the Semiconductor Industry; SIMCO, an Illinois Tool Works Company; 1977; pp. 1–35.
Industrial Product Catalog 1998–1999; SIMCO, an Illinois Tool Works Company; 1998; pp. 1–33.
A Basic Guide to an ESD Control Program for Electronics Manufacturers; SIMCO, an Illinois Tool Works Company; 1995; pp. 1–12.

(List continued on next page.)

*Primary Examiner*—Kiet T. Nguyen
(74) *Attorney, Agent, or Firm*—Akin, Gump, Strauss, Hauer & Feld, L.L.P.

(57) ABSTRACT

Positive and negative ion output are balanced in an electrical ionizer having positive and negative ion emitters, and positive and negative high voltage power supplies associated with the respective positive and negative ion emitters. At least one of the positive and negative high voltage power supplies switches between a high state and a low state. An ion balance sensor is located close to the ion emitters and outputs a voltage value. An ion balance sensor set point voltage value is stored. The voltage value is set to provide a balanced ion condition in the work space near the electrical ionizer. During operation of the electrical ionizer, the output voltage value of the ion balance sensor is compared with the set point voltage value. One of the switchable high voltage power supplies is switched to a high state when it is detected as a result of the comparison that the output voltage value of the ion balance sensor exceeds the set point voltage value in a first direction by a first predetermined amount, and the one of the switchable high voltage power supplies is switched to a low state when it is detected as a result of the comparison that the output voltage value of the ion balance sensor exceeds the set point voltage value in a second direction by a second predetermined amount, the second direction being opposite of the first direction.

44 Claims, 8 Drawing Sheets

U.S. PATENT DOCUMENTS

| | | |
|---|---|---|
| 4,901,194 | 2/1990 | Steinman et al. . |
| 4,951,172 | 8/1990 | Steinman et al. . |
| 4,974,115 | 11/1990 | Breidegam et al. . |
| 5,008,594 | 4/1991 | Swanson et al. . |
| 5,047,892 | 9/1991 | Sakata et al. . |
| 5,055,963 | 10/1991 | Partridge . |
| 5,057,966 | 10/1991 | Sakata et al. . |
| 5,153,811 | 10/1992 | Rodrigo et al. . |

OTHER PUBLICATIONS

Aerostat® PC™ Personalized Coverage Ionizing Air Blower; SIMCO, an Illinois Tool Works Company; 1997; 2 pages.

Aerostat® Guardian™ Overhead Ionizer; SIMCO, an Illinois Tool Works Company; 1997; 2 pages.

Aerostat® Guardian™ CR Overhead Ionizer; SIMCO, an Illinois Tool Works Company; 1998; 2 pages.

EA–3 Charged Plate Monitor; SIMCO, an Illinois Tool Works Company; 1997; 1 page.

Product Specification, Hand•E•Stat Electostatic Fieldmeter; SIMCO, an Illinois Tool Works Company; 1996; 1 page.

Aerostat® XC Extended Coverage Ionizing Air Blower; SIMCO, an Illinois Tool Works Company; 1997; 2 pages.

IntelliStat™ 48 Overhead Ionizer; SIMCO, an Illinois Tool Works Company; 1998; 2 pages.

Air Ring® 1000 Ionizer; SIMCO, an Illinois Tool Works Company; 1998; 2 pages.

Qwik Trac™ Ionization Bar; SIMCO, an Illinois Tool Works Company; 1998; 2 pages.

PulseBar® Static Neutralization Bars; SIMCO, an Illinois Tool Works Company; 1997; 2 pages.

CleanTrac™ Ultra–Clean Ionization Bar; SIMCO, an Illinois Tool Works Company; 1997, 1998; 2 pages.

INSTANTANEOUS BALANCE CONTROL SCHEME FOR IONIZER

CROSS-REFERENCE TO RELATED APPLICATIONS

This application claims the benefit of U.S. Provisional Application No. 60/101,019 filed Sep. 18, 1998 entitled "OVERHEAD IONIZER WITH MICROPROCESSOR-BASED SOFTWARE-CONTROLLED BALANCING CIRCUIT AND WIRED REMOTE CONTROL PANEL."

BACKGROUND OF THE INVENTION

Controlling static charge is an important issue in semiconductor manufacturing because of its significant impact on the device yields. Device defects caused by electrostatically attracted foreign matter and electrostatic discharge events contribute greatly to overall manufacturing losses.

Many of the processes for producing integrated circuits use non-conductive materials which generate large static charges and complimentary voltage on wafers and devices.

Air ionization is the most effective method of eliminating static charges on non-conductive materials and isolated conductors. Air ionizers generate large quantities of positive and negative ions in the surrounding atmosphere which serve as mobile carriers of charge in the air. As ions flow through the air, they are attracted to oppositely charged particles and surfaces. Neutralization of electrostatically charged surfaces can be rapidly achieved through the process.

Air ionization may be performed using electrical ionizers which generate ions in a process known as corona discharge. Electrical ionizers generate air ions through this process by intensifying an electric field around a sharp point until it overcomes the dielectric strength of the surrounding air. Negative corona occurs when electrons are flowing from the electrode into the surrounding air. Positive corona occurs as a result of the flow of electrons from the air molecules into the electrode.

To achieve the maximum possible reduction in istatic charges from an ionizer of a given output, the ionizer must produce equal amounts of positive and negative ions. That is, the output of the ionizer must be "balanced." If the ionizer is out of balance, the isolated conductor and insulators can become charged such that the ionizer creates more problems than it solves. Ionizers may become imbalanced due to power supply drift, power supply failure of one polarity, contamination of electrodes, degradation of electrodes, or ambient air conditions such as changes in permeability or humidity. In addition, the output of an ionizer may be balanced, but may drop below its desired level due to system component degradation.

Accordingly, ionization systems incorporate monitoring, automatic balancing via feedback systems, and alarms for detecting uncorrected imbalances and out-of-range outputs. Most feedback systems are entirely or primarily hardware-based. Many of these feedback systems cannot provide very fine balance control, since feedback control signals are fixed based upon hardware component values. Furthermore, the overall range of balance control of such hardware-based feedback systems may be limited based upon the hardware component values. Also, many of the hardware-based feedback systems cannot be easily modified since the individual components are dependent upon each other for proper operation.

A charged plate monitor is typically used to calibrate and periodically measure the actual balance of an electrical ionizer. The charged plate monitor is also used to measure static charge decay time. If the decay time is too slow or too fast, the ion output may be adjusted by increasing or decreasing the preset ion current value. This adjustment is typically performed by adjusting two trim potentiometers (one for positive ion generation and one for negative ion generation).

Ionization systems may be used to control static charge in an entire room or in a predefined work surface area. FIG. 1 shows a conventional "overhead ionized air blower" or "overhead ionizer" 10 for controlling static charge on top of work surface 12. The overhead ionizer 10 provides a cushion of ionized air protection above the work surface 12, such as from 0–4 inches above the work surface 12. The overhead ionizer 10 is typically hung over the work surface, such as about 30 inches above the work surface. The overhead ionizer 10 includes therein a plurality of ionizers 14 and a plurality of fans 16, each fan being associated with one ionizer 14. One conventional scheme uses three pairs of ionizers $\mathbf{14}_1$–$\mathbf{14}_3$/fans $\mathbf{16}_1$–$\mathbf{16}_3$. The fans 16 create a unidirectional airflow downward from the ionizer 10 to the work surface 12. Power is provided to the fans 16 in parallel with the respective ionizers 14 so that both are either on or off. Fan speed can be adjusted, but the adjustment simultaneously adjusts all fans equally.

When a reading from a charged plate monitor detects an ion imbalance or insufficient ion output, the ion balance and/or ion output must be adjusted. Conventional ionizers 14 contain analog trim potentiometers or digital potentiometers for making such adjustments. To make adjustments in a conventional overhead ionizer 10, a person must reach up to the overhead ionizer 10 to adjust the analog potentiometers or to press UP/DOWN buttons which control digital potentiometer settings. Each ionizer $\mathbf{14}_1$–$\mathbf{14}_3$ has a separate set of potentiometers. One significant problem with the conventional balance adjustment scheme is that the person's physical movements for performing the adjustment and the physical presence of the person in or near the cushion of ionized air protection interferes with proper adjustment and may introduce sudden, large static charges into the work area.

Automatic balance control systems in conventional ionizers are also inherently limited in how quickly and precisely they can achieve a balanced condition. In a conventional automatic balance control system, imbalances are detected by iteratively measuring balance over a plurality of past time periods and then guessing how to adjust one or both of the positive and negative power supplies to achieve a balanced condition in subsequent time periods. This scheme has at least two significant problems. First, by sampling past time periods to determine subsequent adjustments, the scheme introduces a lag time in the balance adjustments during which time the ionizer is imbalanced. Second, this scheme cannot provide a long-term balanced condition. That is, if the ionizer is too positive for a few milliseconds, the ionizer merely corrects for the excess positive ions by moving towards a balanced condition wherein there are a lesser amount of excess positive ions. No effort is made to compensate for the few milliseconds of being too positive, such as by being too negative by the same amount for a few milliseconds. These two problems limit the ability of conventional balance schemes to provide ideal short-term and long-term balanced conditions.

Accordingly, there is an unmet need for a scheme which allows overhead ionizers to be adjusted without interfering with the static field in the work area to be neutralized. There is also an unmet need for an improved balance adjustment scheme. Furthermore, there is an unmet need to allow ionizer fans to be operated in a more flexible manner with respect to their ionizer. Lastly, there is an unmet need for a fast and precise balance adjustment scheme. The present invention fulfills these needs.

BRIEF SUMMARY OF THE PRESENT INVENTION

The present invention provides a scheme for balancing positive and negative ion output in an electrical ionizer having positive and negative ion emitters, and positive and negative high voltage power supplies associated with the respective positive and negative ion emitters. In the scheme, at least one of the positive and negative high voltage power supplies switches between a high state and a low state. An ion balance sensor is located close to the ion emitters and outputs a voltage value. An ion balance sensor set point voltage value is stored. The voltage value is set to provide a balanced ion condition in the work space near the electrical ionizer. During operation of the electrical ionizer, the output voltage value of the ion balance sensor is compared with the set point voltage value. One of the switchable high voltage power supplies is switched to a high state when it is detected as a result of the comparison that the output voltage value of the ion balance sensor exceeds the set point voltage value in a first direction by a first predetermined amount, and the one of the switchable high voltage power supplies is switched to a low state when it is detected as a result of the comparison that the output voltage value of the ion balance sensor exceeds the set point voltage value in a second direction by a second predetermined amount, the second direction being opposite of the first direction.

BRIEF DESCRIPTION OF THE DRAWINGS

The following detailed description of preferred embodiments of the present invention would be better understood when read in conjunction with the appended drawings. For the purpose of illustrating the present invention, there is shown in the drawings embodiments which are presently preferred. However, the present invention is not limited to the precise arrangements and instrumentalities shown. In the drawings.

DETAILED DESCRIPTION OF THE INVENTION

Figure 1:
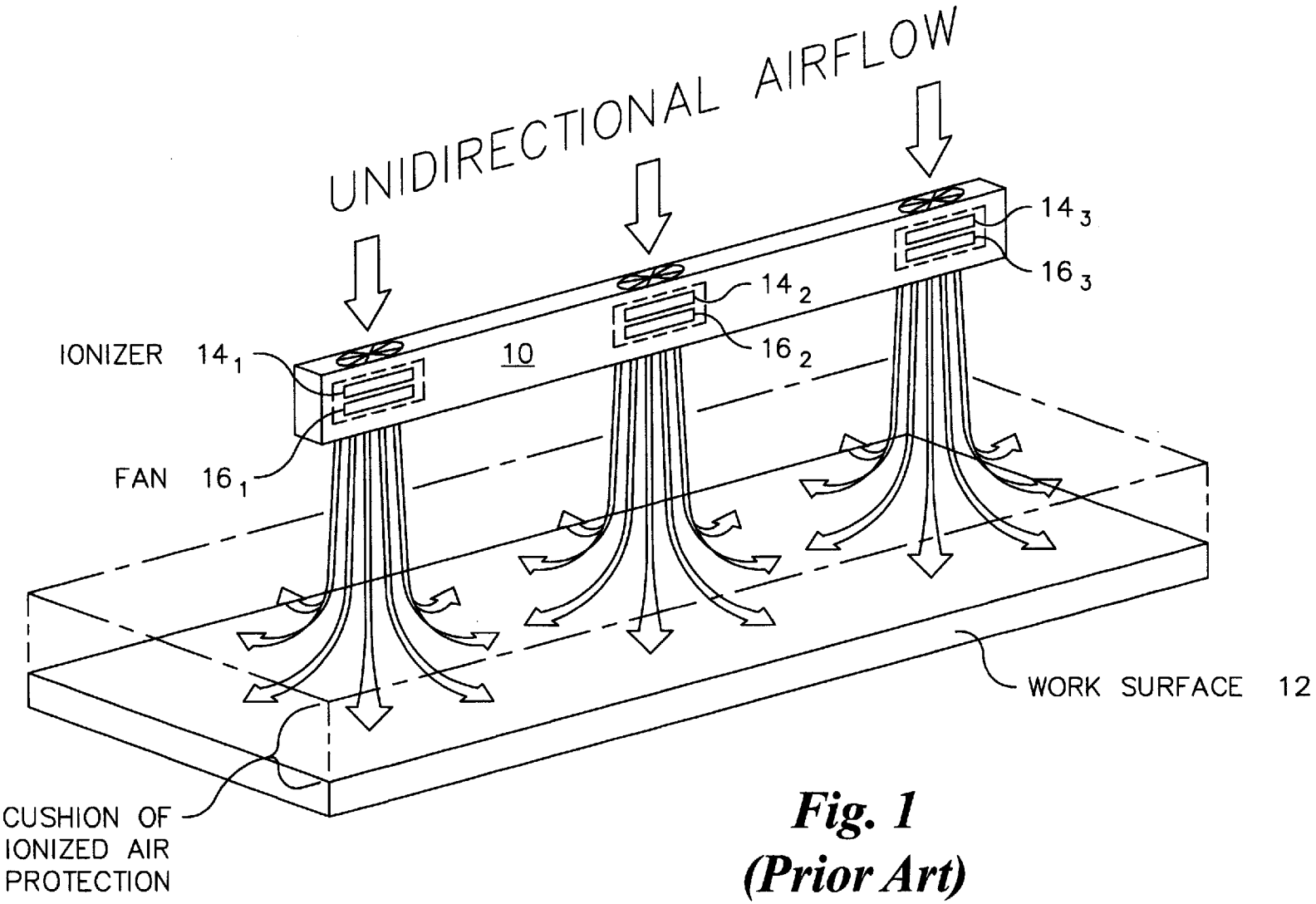
Fig. 1 (Prior Art)
FIG. 1 is a perspective view of a conventional overhead ionizer.

Certain terminology is used herein for convenience only and is not to be taken as a limitation on the present invention. In the drawings, the same reference letters are employed for designating the same elements throughout the several figures.

Figure 2A:
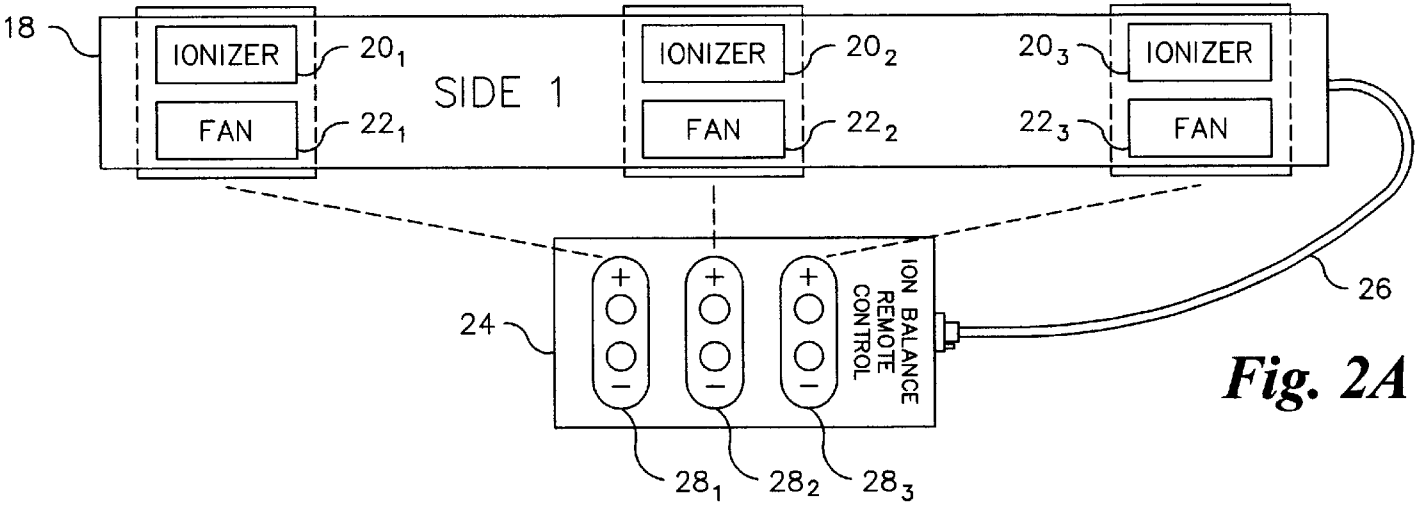
FIG. 2A is an elevation view of an overhead ionizer of the present invention, taken from a first (front) side of the ionizer, and a wired remote control therefor in accordance with the present invention.
Figure 2B:
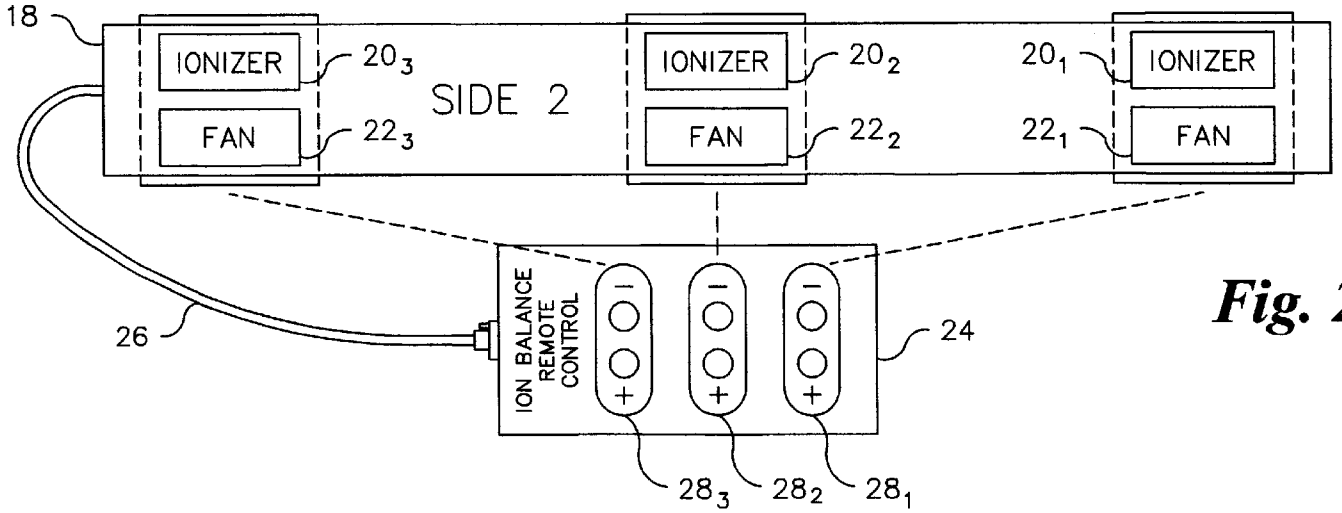
FIG. 2B is an elevation view of an overhead ionizer of the present invention, taken from a second (rear) side of the ionizer, and a wired remote control therefor in accordance with the present invention.

FIGS. 2A and 2B show a DC "overhead ionized air blower" or DC "overhead ionizer" 18 for controlling static charge in accordance with the present invention. The overhead ionizer 18 is preferably arranged in the same manner with respect to a work surface as the conventional overhead ionizer 10 of FIG. 1. Like the overhead ionizer 10, the overhead ionizer 18 includes therein a plurality of electrical ionizers 20 and a plurality of fans 22, each fan being associated with one ionizer 20. For example, one preferred embodiment of the invention has three pairs of ionizers $\mathbf{20}_1$–$\mathbf{20}_3$/fans $\mathbf{22}_1$–$\mathbf{22}_3$.

Figure 4:
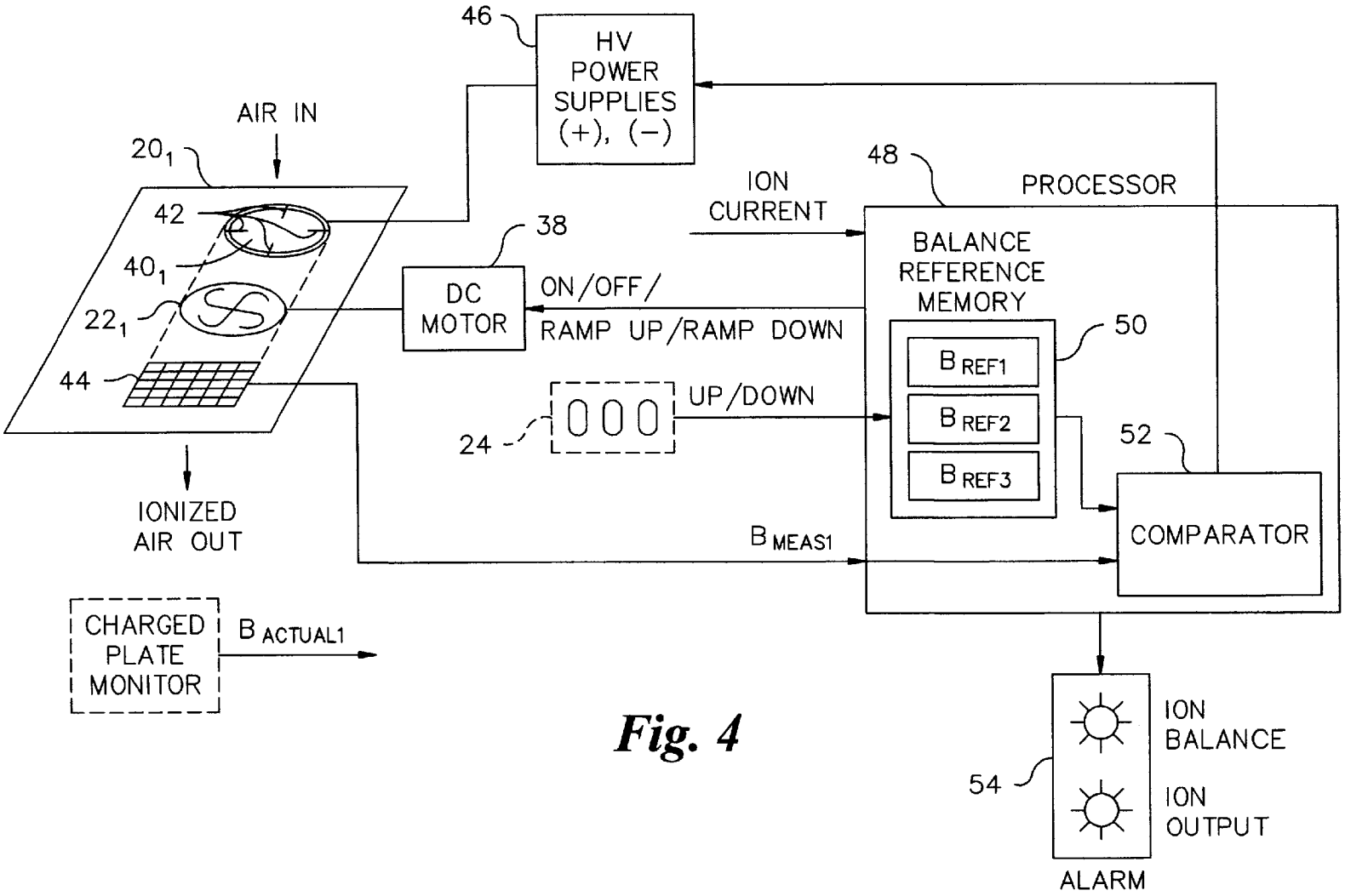
FIG. 4 is an exploded view of one ionizer inside of the overhead ionizer of FIG. 2A, and is also a schematic block diagram of microprocessor-controlled circuitry for operating the overhead ionizer of FIG. 2A.

Unlike a conventional ionizer 14 which sets and adjusts balance settings using analog or digital potentiometers, balance settings for the ionizers 20 are stored in memory associated with a microprocessor located inside the housing of the overhead ionizer 18 (shown schematically in FIG. 4). Additional details of the overhead ionizer 18 circuitry are discussed below.

An important feature of the present invention is the use of a wired remote control 24 (shown enlarged with respect to the overhead ionizer 18 for illustration purposes only) for adjusting the balance reference parameter stored in memory. The remote control 24 is wired to the overhead ionizer 18 via detachable cable 26, which may be a standard modular telephone cable. A length of seven feet is sufficient to allow the user to avoid the "keep out" zone (i.e., the zone where the user's presence and movements interfere with the balance adjustment). The remote control 24 includes a pair of (+)/(−) buttons $\mathbf{28}_1$–$\mathbf{28}_3$ to control balance for each of the ionizers $\mathbf{20}_1$–$\mathbf{20}_3$. The pairs of buttons $\mathbf{28}_1$–$\mathbf{28}_3$ (generically, $\mathbf{28}_3$–$\mathbf{28}_n$) are arranged sequentially with respect to each pair. The (+) and (−) buttons within each button pair may be arranged in any particular orientation.

Furthermore, the remote control 24 is designed to have a particular working relationship between the buttons 28, the ionizers 20 and the cable 26. Specifically, the button pair 28 nearest the end of the cable 26 which connects to the remote control 24 adjusts the ionizer 20 nearest the end of the cable 26 which connects to the overhead ionizer 18. Likewise, the button pair 28 farthest from the end of the cable 26 which connects to the remote control 24 adjusts the ionizer 20 farthest from the end of the cable 26 which connects to the overhead ionizer 18. Intermediate button pairs 28 control respective intermediate ionizers 20 in the same order. This design makes use of the remote control 24 intuitive for the person adjusting the balance. By holding the remote control cable 26 so that it points toward the end of the overhead ionizer 18 that the cable 26 is connected to, the button pairs 28 become oriented in the same order as the ionizers 20 which they control, as shown by the dashed lines in FIGS. 2A and 2B. Furthermore, the orientation remains the same regardless of whether the remote control 24 is located facing the front side (side 1) of the overhead ionizer 18 (FIG. 2A), or the rear side (side 2) of the overhead ionizer 18 (FIG. 2B). In addition, adjustments are easy to make even if the cable 26 is twisted or has a tortured path, or if the remote control 24 is held in other orientations with respect to the overhead ionizer 18, such as rotated 90 degrees. In either instance, the person performing the adjustment need only mentally note the relationship between the button pairs 28, the ionizers 20 and the cable 26 by following the cable path and visually noting which button pairs 28 and ionizers 18 are closest and farthest from their respective ends of the cable 26. When using this scheme, it is not necessary to label the individual ionizers 20 or the button pairs 28.

In an alternative embodiment of the present invention, the cable 26 may be replaced by a wireless system, such as by using a wireless remote control 24 containing an infrared transmitter and providing an infrared receiver on the overhead ionizer 18.

As discussed above, a person's physical movements which occur while performing the balance adjustment and the physical presence of the person in or near the cushion of ionized air protection interferes with proper adjustment and may introduce sudden, large static charges into the work area. No conventional overhead ionizers which the inventors are aware of provide manual remote control adjustments which allow the adjustments to be made outside of the "keep out" zone and without such interference. Furthermore, conventional remote controls which adjust the same function on different elements of the same units do not provide an intuitive arrangement of adjustment buttons, nor do they account for situations when the units to be adjusted may be approached from different orientations. The design scheme shown in FIGS. 2A and 2B is believed to overcome deficiencies in such remote controls.

Figure 3:
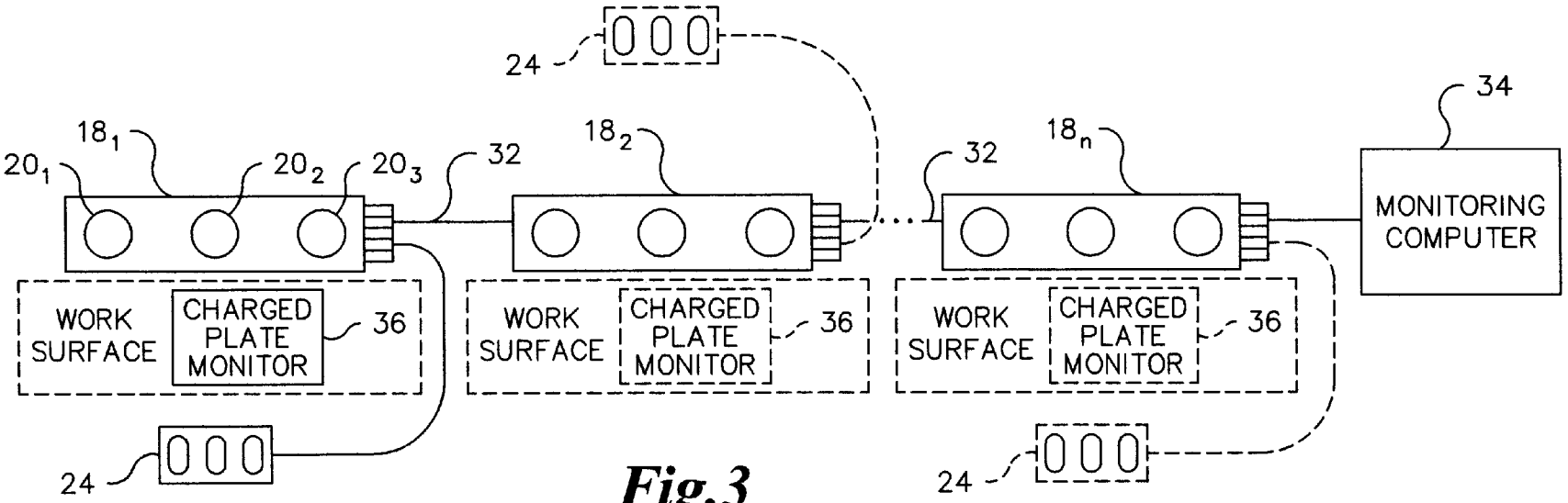
FIG. 3 is a schematic diagram of a plurality of overhead ionizers of FIG. 2A.

FIG. 3 shows a work area which contains a plurality of overhead ionizers $\mathbf{18}_1$–$\mathbf{18}_n$ connected in a daisy-chain manner by RS-485 communication lines 32 to a monitoring computer 34. During periodic calibration and/or initial setup, a charged plate monitor 36 is placed on the work surface of overhead ionizer 18, to obtain an actual balance reading. If adjustments are necessary, the person making the adjustment plugs in the remote control 24 and adjusts the particular ionizer $\mathbf{20}_1$, $\mathbf{20}_2$ or $\mathbf{20}_3$ that is most strongly influencing the charged plate monitor 36. The remote control 24 may be plugged into an unused jack of the communication line connector, as shown in FIG. 3. Alternatively, the communication line 32 may be removed, and the remote control 24 may be plugged therein (not shown). The charged plate monitor 36 may be moved along the work surface to check and adjust the balance of each ionizer $\mathbf{20}_1$, $\mathbf{20}_2$ and $\mathbf{20}_3$. Next, the charged plate monitor 36 is moved to the work surface of overhead ionizer $\mathbf{18}_2$, the remote control 24 is connected to the communication jack of the overhead ionizer $\mathbf{18}_2$, and the balance adjustment process is repeated again.

FIG. 4 is a schematic block diagram of microprocessor-controlled circuitry for operating an overhead ionizer 18. For illustration purposes, FIG. 4 shows overhead ionizer $\mathbf{18}_1$ and ionizer $\mathbf{20}_1$ associated therewith.

The hardware components of the ionizer $\mathbf{20}_1$ include a low voltage DC fan $\mathbf{22}_1$ controlled by a DC motor 38 which draws air in through ionizing chamber $\mathbf{40}_1$. The ionizing chamber $\mathbf{40}_1$, which is on the intake side of the fan $\mathbf{22}_1$, contains ion emitters (points) 42 which are removable for maintenance. The exhaust side of the fan $\mathbf{22}_1$ contains an ion balance sensor 44. The exhaust side of the fan $\mathbf{22}_1$ distributes the ionized air containing the positive and negative ions for static neutralization. The overhead ionizer 18 is powered internally by a universal input power supply capable of operating on any input power between 100–240 VDC, 50/60 Hz. Power input is by a standard IEC320 connector, with power output available at the opposite end by a standard IEC320 outlet. These hardware components are conventional, and thus are not explained in more detail herein.

Each ionizing chamber 40 within each overhead ionizer 18 is energized by separate positive and negative high voltage power supplies 46 under the independent control of a processor 48, which is preferably a microprocessor. The processor 48 includes a balance reference memory 50 and a comparator 52. The memory 50 stores the balance reference values for each of the ionizers 20 associated with the overhead ionizer 18. In the example of a three-unit overhead ionizer 18, the memory 50 stores three voltage values, $B_{REF1}$, $B_{REF2}$ and $B_{REF3}$. The balance reference value is the desired voltage value of the ion balance sensor 44 associated with the respective ionizer 20. To balance an ionizer $\mathbf{20}_1$, the measured balance, $B_{MEAS1}$, as determined by the ion balance sensor 44, and $B_{REF1}$ are compared in the comparator 52. If the values are equal, no adjustment is made to the positive or negative high voltage power supplies 46. If the values are not equal, appropriate adjustments are made to the power supplies 46 until the values become equal. This process occurs continuously and automatically during operation of the ionizer $\mathbf{20}_1$. During calibration or initial setup, balance readings are taken from a charged plate monitor to obtain an actual balance reading, $B_{ACTUAL1}$, in the work space near the ionizer $\mathbf{20}_1$. If the output of the comparator 52 shows that $B_{REF1}$ equals $B_{MEAS1}$, and if $B_{ACTUAL1}$ is zero, then the ionizer $\mathbf{20}_1$ is balanced and no further action is taken. However, if the output of the comparator 52 shows that $B_{REF1}$ equals $B_{MEAS1}$, and if $B_{ACTUAL1}$ is not zero, then the ionizer $\mathbf{20}_1$ is unbalanced. Accordingly, $B_{REF1}$ is adjusted up or down by using the remote control 24. During calibration or initial setup, the charged plate monitor is moved to obtain actual balance reading, $B_{ACTUAL2}$ and $B_{ACTUAL3}$, in the work spaces near the ionizer $\mathbf{20}_2$ and $\mathbf{20}_3$, and the process described above is repeated for such ionizers. Due to manufacturing tolerances and system degradation over time, each ionizer 20 will thus likely have a different $B_{REF}$ value.

Each overhead ionizer 18 includes an alarm 54 for signaling when the ion balance cannot be properly controlled, and when the ion current is out of range. The processor 48 outputs the alarm signal. The alarm signals are also transmitted via the communication line 32 to the monitoring computer 34, if such a computer is attached.

Figure 5:
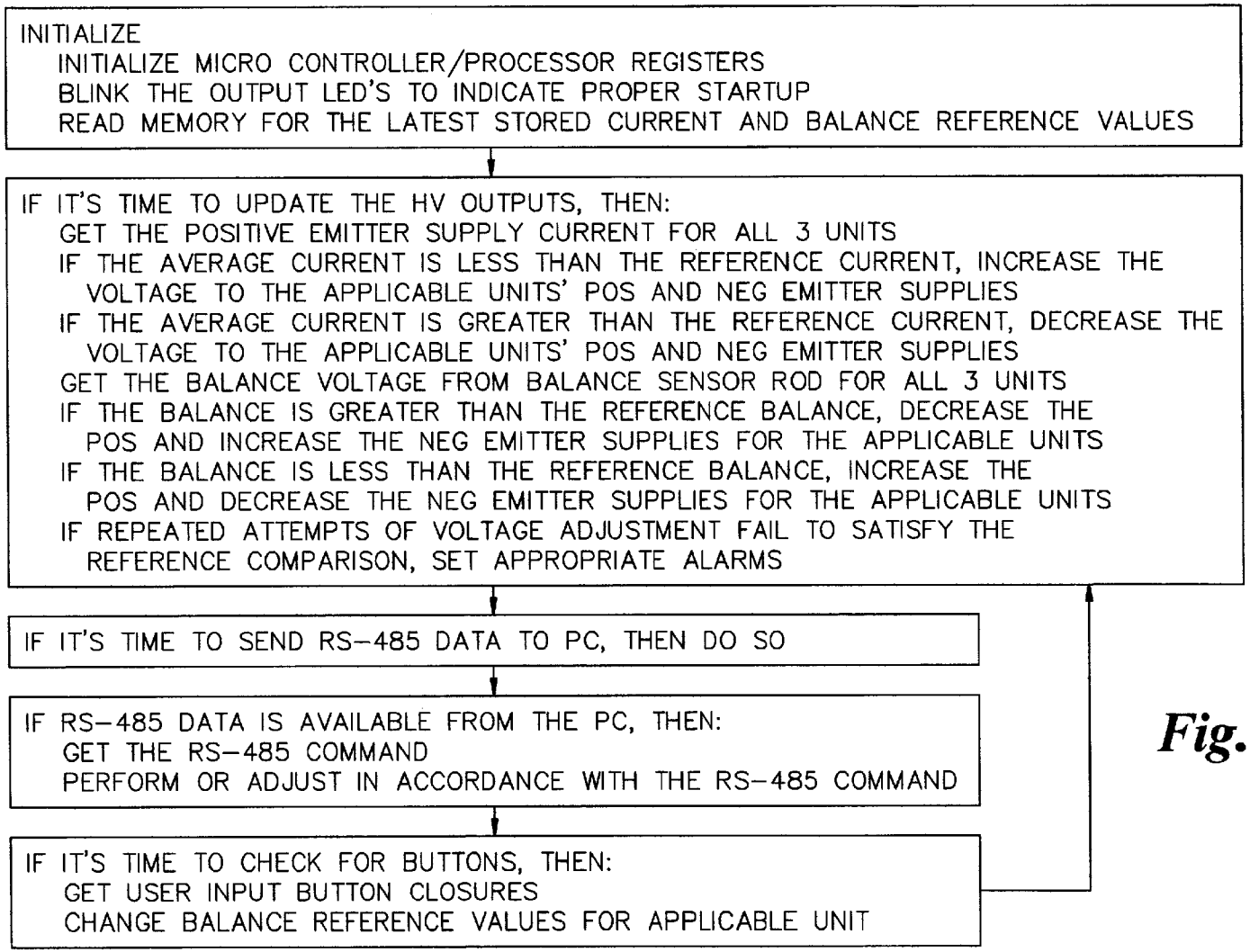
FIG. 5 is a flowchart of the software associated with the processor of the overhead ionizer shown in FIG. 3.

FIG. 5 is a self-explanatory flowchart of the software associated with the processor 48.

As discussed above, conventional automatic balancing systems have hardware-based feedback systems, and suffer from at least the following problems:

(1) Such systems cannot provide very fine balance control, since feedback control signals are fixed based upon hardware component values.

(2) The overall range of balance control is limited based upon the hardware component values.

(3) Quick and inexpensive modifications are difficult to make, since the individual components are dependent upon each other for proper operation. In contrast to conventional systems, the software-based balance control circuitry of the present invention does not suffer from any of these deficiencies.

Microprocessor control of the ionizers 20 and fans 22 within each overhead ionizer 18 allows sophisticated features to be implemented, such as the following features:

(1) The microprocessor monitors the output of the comparator for comparing each of the $B_{ERF}$ and $B_{MEAS}$ values. If the differences are less than a predetermined value, the ionizers 20 are presumed to be making necessary small adjustments associated with normal operation. However, if one of the difference values is greater than a predetermined value at one or more instances of time, the ionizer 20 is presumed to be in need of servicing. In this instance, an alarm is output at the alarm 54 and/or the alarm is sent to the monitoring computer 34, if such a computer is attached.

(2) When operated in a conventional mode, the fans 22 and the ionizers 20 turn on and off simultaneously. Fan speed may be manually adjusted, if desired. When operated under microprocessor control, the processor 48 controls the fan's DC motor 38, and fan operation may be delayed during startup and shutdown to minimize an ion imbalance. For example, during startup, the ionizers 20 may be energized to allow ion balance to stabilize before starting the fans 22. During a shutdown, the fans 22 may be turned off and allowed to come to rest prior to deenergizing the ionizers 20. Alternatively, the fan speed may be ramped up or ramped down to achieve a similar effect.

(3) Automatic ion balance changes for each individual ionizer 20 may be ramped up or ramped down to avoid sudden swings or potential overshoots. For example, when using a steady-state DC mode, the DC amplitude may be gradually adjusted from a first value to the desired value to achieve the desired ramp up or down effect.

As discussed above in the background, automatic balance control systems in conventional ionizers are also inherently limited in how quickly and precisely they can achieve a short-term balanced condition and are not designed to provide long-term balanced conditions. To further illustrate these limitations, consider the example of a conventional pulse width modulation (PWM) scheme wherein fixed width (i.e., fixed frequency) pulse cycles control the positive and negative high voltage power supplies. In one such conventional PWM scheme, the pulse width of the ON/OFF cycles of the negative high voltage power supply varies, while the pulse width of the ON/OFF cycles of the positive high voltage power supply is fixed evenly between the on and off states. The driving voltages are fixed.

In operation, balance readings from an ion balance sensor are monitored and reviewed. If balance readings for recently measured cycles indicate that the balance is too negative, then the ON cycle of the negative power supply is decreased by a predetermined amount. Likewise, if balance readings for recently measured cycles indicate that the balance is too positive, then the ON cycle of the negative power supply is increased by a predetermined amount. The next set of balance readings are reviewed and further adjustments to the ON cycle of the negative power supply are made, if necessary.

Figure 6:
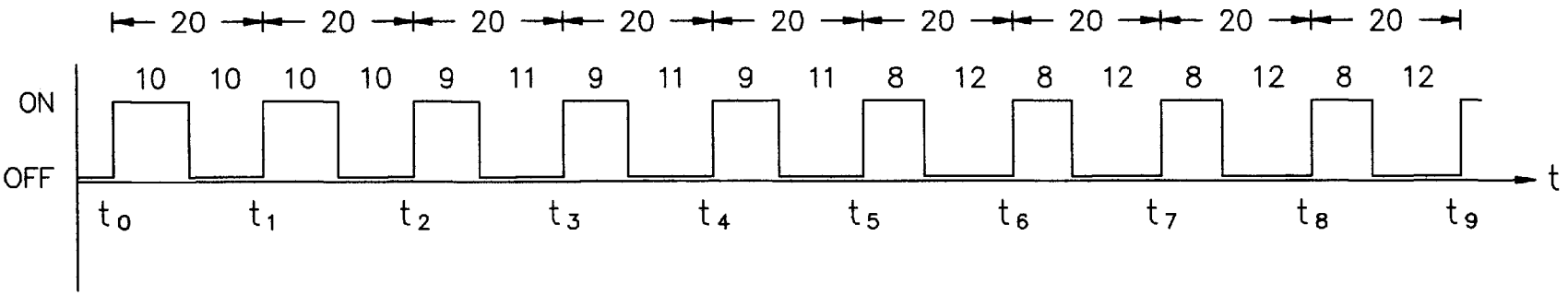
Fig. 6 (Prior Art)
FIG. 6 is an illustration of waveforms associated with a conventional balance control scheme.

FIG. 6 illustrates the prior art scheme described above. The waveform in FIG. 6 is the pulse signal associated with the negative power supply wherein a 20 millisecond (ms) pulse width is used. In an ideal balanced operating state, the ON/OFF times are equally divided between the ON and OFF states (10 ms ON, 10 ms OFF). At time $t_2$, the balance control system detects an imbalanced condition, specifically, an excess of negative ions. As a result, the ON cycle of the negative power supply is decreased by a predetermined amount (e.g., 1 ms) during the next 20 ms cycle, thereby providing 9 ms ON and 11 ms OFF. At time $t_6$, the balance control system is still detecting an excess of negative ions so the ON cycle is further decreased, for example, by another 1 ms, thereby providing 8 ms ON and 12 ms OFF. At time $t_9$, balance has been achieved and the next cycle remains at 8 ms ON and 12 ms OFF.

The process described above fails to provide quick short-term balance control since a plurality of cycles occur before the ionizer is brought back into balance. Typically, balance measurements from a plurality of past cycles (three cycles in the example of FIG. 6) are taken even before any corrective efforts are made. Furthermore, the corrective efforts require additional cycles before balance is achieved. The process described above also fails to provide long-term balance control. Referring to the example in FIG. 6, the balance is too negative between time $t_0$ and $t_7$. However, no effort is made to compensate for the extra negative ions generated during this time period, such as by subsequently producing extra positive ions in addition to rebalancing the ion output. Instead, balance control system works solely to reduce the excess negative ions. Thus, if the system remained in balance for the rest of the operation, or if the ionizer continually repeated the problem of producing excess negative ions, there would be a long-term imbalance of negative ions.

Other conventional schemes which also suffer from the disadvantages discussed above include using a fixed frequency and a fixed duty cycle but varying the input voltages which drive the high voltage DC supplies, and using constantly driven (steady-state) high voltage DC supplies which also vary the driving voltages.

Another important feature of the present invention is an improved balance control scheme which addresses the deficiencies described above by providing instantaneous short-term balance control and zero long-term balance control. One preferred embodiment of the improved balance control scheme works in conjunction with the overhead ionizer 18 described above with respect to FIGS. 2–5. However, the scheme may be applied to any type of ionizer. Thus, the scope of the invention is not limited to the overhead ionizer application described herein.

Figure 7:
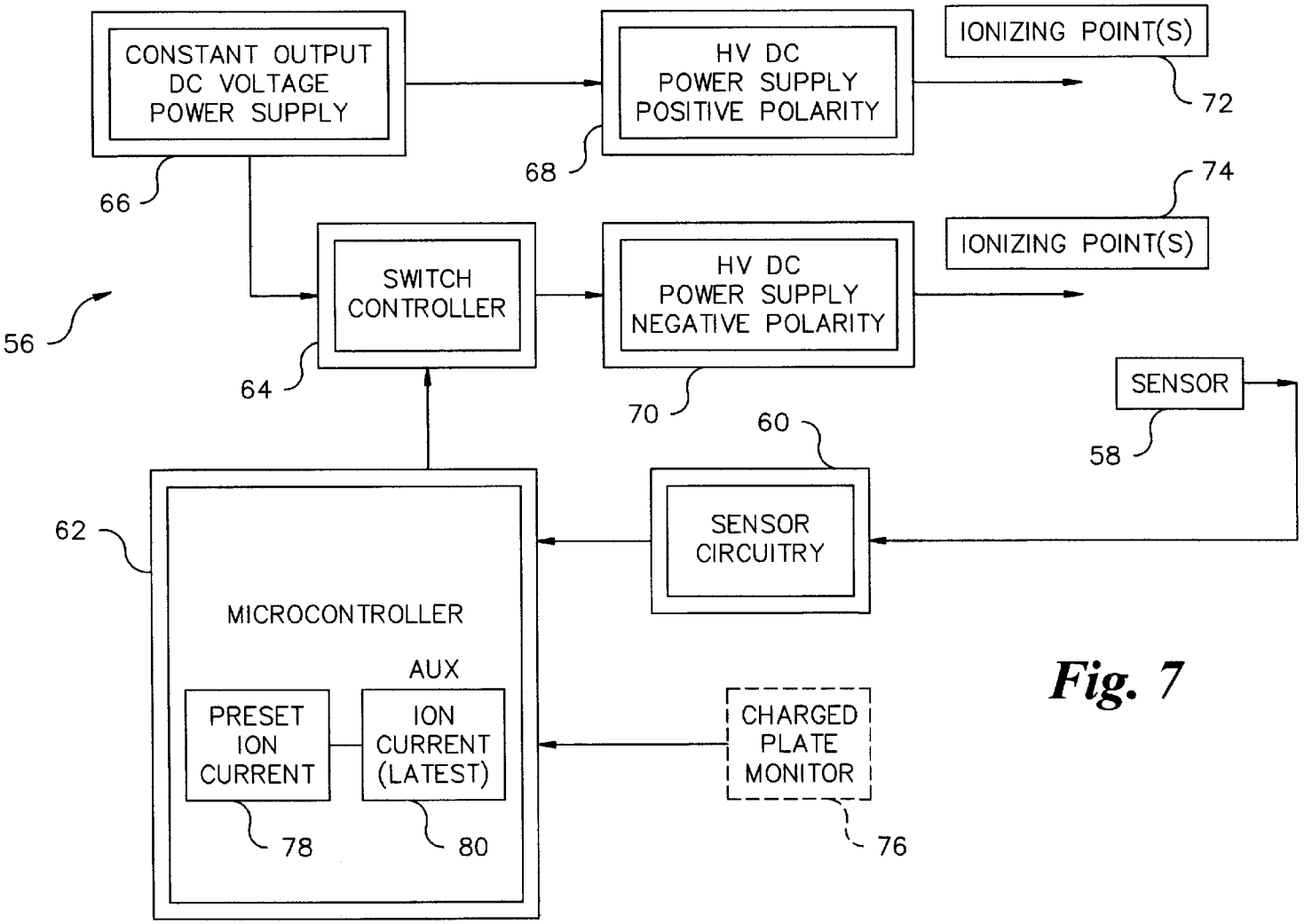
FIG. 7 is a schematic block diagram of a balance control system in accordance with the present invention.
Figure 8:
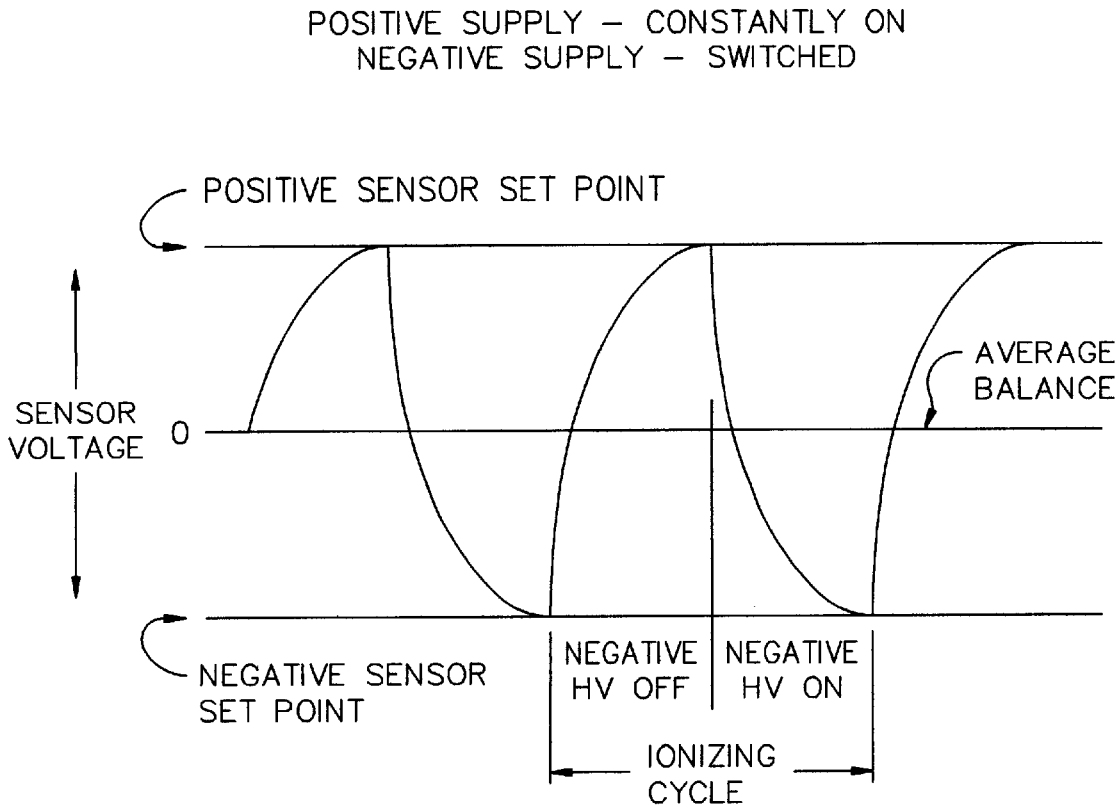
FIG. 8 is a balance sensor waveform generated using the system of FIG. 7 in a first embodiment of the balance control system.

FIG. 7 is a schematic block diagram of a balance control system 56 in accordance with the present invention. FIG. 8 is a balance sensor waveform generated using the system of FIG. 7 in a first embodiment of a balance control scheme.

Referring to FIG. 7, the system 56 includes a sensor 58, sensor circuitry 60, a microcontroller 62, a switch controller 64, a constant output DC voltage power supply 66, a positive and negative polarity HV DC power supply 68 and 70, and respective ionizing point(s) or pin(s) 72 and 74. An optional air moving device (not shown) may be placed near the ionizing points 72 and 74. The sensor 58 is placed near the ionizing points 72 and 74 to provide feedback to the microcontroller 62 That is, the output of the sensor 58 is connected to the input of the sensor circuitry 60, and the output of the sensor circuitry 60 connects to an input of the microcontroller 62. An output of the microcontroller 62 connects to a first input of the switch controller 64 and the output of the DC voltage power supply 66 connects to a second input of the switch controller 64. The output of the DC voltage power supply 66 also connects to the input of the positive polarity HV DC power supply 68. The output of the switch controller 64 connects to the input of the negative polarity NV DC power supply 70. In this manner, the positive polarity of the HV DC power supply 68 is continuously driven at a selected input voltage (e.g., +5V), and thus has a steady state DC output. The negative polarity of the HV DC power supply 70 is driven by the DC voltage power supply 66 through the switch controller 64 under the control of the microcontroller 62. Due to this configuration, the negative polarity HV DC power supply 70 can produce a greater quantity of ions that the positive polarity HV DC power supply 68. The negative polarity of the HV DC power supply 70 thus switches between a high state and a low state based upon the output control signals from the microcontroller 62 which controls the switch controller 64. In alternative embodiment of the invention, the positive polarity of the HV DC power supply 68 is switched and the negative polarity of the HV DC power supply 70 has a steady state DC output. In yet another alternative embodiment of the invention, both polarities of the HV DC power supply are switched.

In one embodiment of the present invention described below, the high state is a fully switched on state wherein power is fully switched on, and the low state is a fully switched off state wherein power is fully switched off. In alternative embodiments of the invention, the high state may be a first voltage level and the second state may be a second voltage level which is lower than the first voltage level, but not necessarily zero.

Referring to FIGS. 7 and 8, the operation of the microcontroller 62 and switch controller 64 is described with respect to a sensor voltage waveform received by the microcontroller 62.

At startup, the continuously driven positive polarity of the HV DC power supply 68 is turned fully on. The microcontroller 62 waits for the sensor 58 to exceed a predetermined but adjustable set point which is of the same polarity as the continuously driven positive power supply 68. For example, the set point may be a voltage level, such as +2V, correlated to an electrostatic analyzer (e.g., a charged plate monitor) placed at a specific distance from the ionizing device. When the voltage level is exceeded, the microcontroller 62 sets the sensor set point to the equal but opposite polarity voltage level, such as −2V, and the negative polarity HV DC supply 70 is turned on. Next, the microcontroller 62 waits for the sensor 58 to exceed the new level (which is −2V in this example), at which time the previous sensor set point (which is +2V in this example) is loaded, and the negative polarity HV DC supply is turned off, beginning a new cycle.

A "set point" of zero is the point in which a charged plate monitor should give a balance reading of zero.

The balance control system described above may be used with the overhead ionizer 18 shown in FIG. 2A and 4. Alternatively, the balance control system may be used in other types of ionizers. If the balance control system is used in the overhead ionizer 18, the initial set point is stored. (The positive set point is equal to BREF+an offset number, whereas the negative set point is equal to BREF−the same offset number. If, during use, the positive supply has to be adjusted from the original set value (e.g., +2V to +2.2V), then the new set point is stored for subsequent turn-on. Also, the microcontroller 62 has a memory 78 for storing a preset ion current value, as well as an auxiliary memory 80 for storing an ion current value which is the latest ion current value. During operation, if a value exists in the auxiliary memory 80, then that value is used. If no value exists in the auxiliary memory 80, then the value in memory 78 is used.

In a scheme wherein the switching occurs upon the sensor voltage "reaching" the set point, there is a lag time between the switching of the negative HV DC supply and the effect in the field on the actual ion balance, as measured by the sensor voltage. This effect causes the sensor voltage to slightly exceed the set point. This effect is not shown in FIG. 7.

The scheme described above is essentially a pulse width modulation form of operation. Since the sensor level controls the supplies, differences of operation from cycle to cycle are accounted for, resulting in varying frequency and duty cycle. The net result is a more stable balance control in the short-term as well as in the long-term. That is, short-term imbalance conditions are corrected in every cycle, without having to wait a plurality of cycles as required by conventional balance control schemes. In fact, the average balance is always zero in every cycle. Accordingly, the long-term average balance is also always zero. As discussed above, conventional schemes inherently do not compensate for long-term imbalanced conditions.

The scheme described in FIG. 8 operates on two reference levels (set points) and reacts according to present conditions. If something interferes with or inhibits the ionization process, no change of state occurs with respect to the negative polarity HV DC supply 70 until the proper set point is reached. This effectively lengthens the duty cycle. In contrast, if something enhances the ionization process, such as point cleaning, the set point limits are reached more quickly, resulting in a reduced duty cycle. The overall "frequency" is based upon the sensor set points, with higher set points resulting in a slower frequency. That is, the longer it takes to reach the set point, the less cycles will occur in a given period of time.

The balance control system of the present invention allows the user to monitor the condition of the constantly driven HV DC supply (positive supply in the embodiment of FIG. 8) and to adjust for ionizing point wear. For example, a reduction in the output voltage of the positive supply may be detected by a reduction in the duty cycle of the negative supply.

Figure 9:
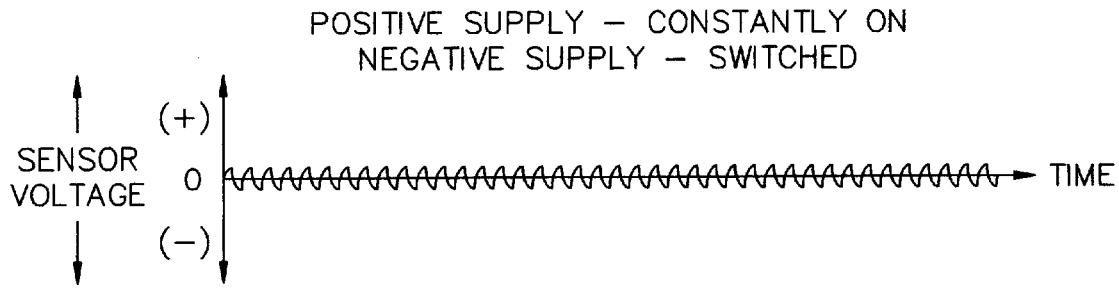
FIG. 9 is a balance sensor waveform generated using the system of FIG. 7 in a second embodiment of the balance control system.

FIG. 9 is a balance sensor waveform generated using the system of FIG. 7 in a second embodiment of a balance control scheme. In the scheme of FIG. 9, there is a single set point. The negative supply is turned on when the output voltage of the ion balance sensor 58 exceeds the set point in a first direction (e.g., positive direction) by a first predetermined amount, and the negative supply is turned off when the output voltage of the ion balance sensor 58 exceeds the set point in a second direction (e.g., negative direction) by a second predetermined amount. The first and second predetermined amounts may be the same, as shown in FIG. 9, or they may be different amounts. The single set point voltage is the voltage which causes a zero voltage on a charged plate monitor (CPM) at a particular distance from the ionizer, such as 18 inches. In the example of FIG. 9, the set point voltage is zero. The resultant sensor voltage waveform has a sinusoidal appearance. The lag time between the switching of the negative HV DC supply and the effect in the field on the actual ion balance, as measured by the sensor voltage, contributes to the sinusoidal waveform. The scheme in FIG. 9 provides faster corrections for imbalance than the scheme in FIG. 8, assuming that the processing speed of the sensor voltage checking process and the response time of the negative polarity high voltage power supply are the same in both schemes.

Figure 10:
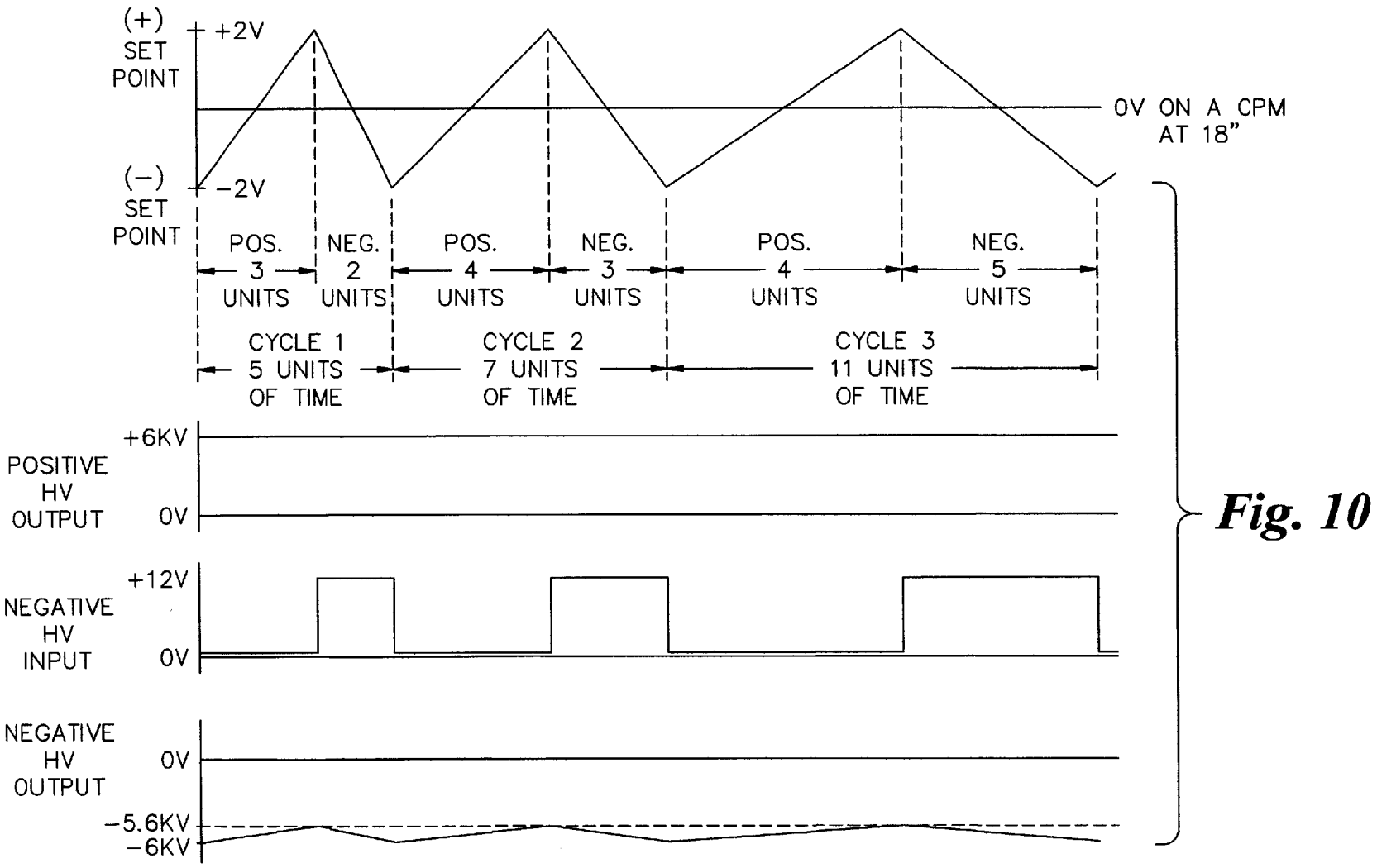
FIG. 10 is a combined diagram of waveforms associated with the sensor and power supplies of FIG. 7 in a further illustration of the balance control system.

FIG. 10 is a combined diagram of waveforms associated with the sensor and power supplies of FIG. 7 in a further illustration of the balance control system. Some of the waveforms in FIG. 10 are exaggerated or simplified to illustrate the invention. FIG. 10 illustrates a two sensor set point scheme, similar to FIG. 8.

The first waveform in FIG. 10 is a balance sensor waveform and shows how duty cycle and frequency may vary to maintain a balanced condition. The second waveform shows the constant output of the constantly on positive polarity HV DC supply 68. The third waveform shows the input voltage of the negative polarity HV DC supply 70 (i.e. the drive voltage of the negative polarity HV DC supply 70). The fourth waveform shows the output of the negative polarity HV DC supply 70. Due to the stored energy in the power supply 70, the output voltage does not turn completely on and off even though the input drive voltage turns completely on and off. Instead, the output voltage rises and falls from a maximum output voltage as the drive voltage switches on and off. In the example of FIG. 10, the output voltage varies between −5.6 kV and −6.0 kV as the drive voltage varies between 0V and 12V. Other switching schemes are within the scope of the invention. For example, as discussed above, the switched power supply may have its input voltage switched between any two input voltage levels, not necessarily a fully switched off and fully switched on level.

Alternative schemes which use the same inventive principle and achieve the same goal as the schemes described above are within the scope of the invention. Some variations are as follows:

1. The positive polarity HV DC supply may be switched and the negative polarity HV DC supply may be constantly driven.

2. The positive and negative polarity HV DC supplies may both be switched. In the schemes of FIGS. 8 and 9, the positive supply would be switched on whenever the negative supply is switched off, and vice-versa. This scheme would allow for faster balancing but would require more complex and expensive switching circuitry and software control.

3. A charged plate monitor 76 may be used in place of the sensor 58 to provide the data for the microcontroller 62 to generate the switching signals.

In experiments conducted with conventional balance control systems and the balance control system of the present invention, short-term tests show that charged plate monitor readings in conventional systems vary between ±5–10 volts, wherein readings taken using the balance control system of the present invention vary between ±2–3 volts.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. A method of balancing positive and negative ion output in an electrical ionizer having (i) positive and negative ion emitters, and (ii) positive and negative high voltage power supplies associated with the respective positive and negative ion emitters, at least one of the positive and negative high voltage power supplies switching between a high state and a low state, the method comprising:

(a) providing an ion balance sensor located close to the ion emitters, the ion balance sensor outputting a voltage value;

(b) storing an ion balance sensor set point voltage value, the voltage value being set to provide a balanced ion condition in the work space near the electrical ionizer;

(c) during operation of the electrical ionizer, comparing the output voltage value of the ion balance sensor with the set point voltage value;

(d) switching one of the switchable high voltage power supplies to a high state when it is detected as a result of the comparison that the output voltage value of the ion balance sensor exceeds the set point voltage value in a first direction by a first predetermined amount; and (e) switching the one of the switchable high voltage power supplies to a low state when it is detected as a result of the comparison that the output voltage value of the ion balance sensor exceeds the set point voltage value in a second direction by a second predetermined amount, the second direction being opposite of the first direction.

2. A method according to claim 1 wherein one of the positive and negative high voltage power supplies has a steady state DC output, and the other of the positive and negative high voltage power supplies switches between a high state and a low state, wherein step (d) comprises switching the switchable high voltage power supply to a high state when it is detected as a result of the comparison that the output voltage value of the ion balance sensor exceeds the set point voltage value in a first direction by a first predetermined amount; and wherein step (e) comprises switching the switchable high voltage power supply to a low state when it is detected as a result of the comparison that the output voltage value of the ion balance sensor exceeds the set point voltage value in a second direction by a second predetermined amount.

3. A method according to claim 2 wherein the positive high voltage power supply has a steady state DC output, and the negative high voltage power supply switches between a high state and a low state, and steps (d) and (e) switch the negative high voltage power supply to the high and low states.

4. A method according to claim 1 wherein the positive and negative high voltage power supplies both switch between a high state and a low state, wherein step (d) further comprises switching the other of the switchable high voltage power supplies to a low state when it is detected as a result of the comparison that the output voltage value of the ion balance sensor exceeds the set point voltage value in a first direction by a first predetermined amount; and wherein step (e) further comprises switching the other of the switchable high voltage power supplies to a high state when it is detected as a result of the comparison that the output voltage value of the ion balance sensor exceeds the set point voltage value in a second direction by a second predetermined amount.

5. A method according to claim 1 wherein the high state provides fully switched on input power to the at least one switchable high voltage power supply, and the low state provides fully switched off input power to the at least one switchable high voltage power supply.

6. A method according to claim 1 wherein the high state provides a first input voltage to the at least one switchable high voltage power supply, and the low state provides a second input voltage lower than the first input voltage to the at least one switchable high voltage power supply.

7. A method according to claim 1 wherein the first and second predetermined values are identical.

8. A method of balancing positive and negative ion output in an electrical ionizer having (i) positive and negative ion emitters, and (ii) positive and negative high voltage power supplies associated with the respective positive and negative ion emitters, at least one of the positive and negative high voltage power supplies switching between a high state and a low state, the method comprising:

(a) providing an ion balance sensor located close to the ion emitters, the ion balance sensor outputting a voltage value;

(b) storing a positive ion balance sensor set point voltage value and a negative ion balance sensor set point voltage value;

c) during operation of the electrical ionizer, comparing the output voltage value of the ion balance sensor with the positive and negative set point voltage values;

(d) switching one of the switchable high voltage power supplies to a high state when it is detected as a result of the comparison that the output voltage value of the ion balance sensor exceeds one of the positive and negative set point voltage values; and (e) switching the one of the switchable high voltage power supplies to a low state when it is detected as a result of the comparison that the output voltage value of the ion balance sensor exceeds the other of the positive and negative set point voltage values.

9. A method according to claim 8 wherein one of the positive and negative high voltage power supplies has a steady state DC output, and the other of the positive and negative high voltage power supplies that switches between a high state and a low state, wherein step (d) comprises switching the switchable high voltage power supply to a high state when it is detected as a result of the comparison that the output voltage value of the ion balance sensor exceeds one of the positive and negative set point voltage values; and wherein step (e) comprises switching the switchable high voltage power supplies to a low state when it is detected as a result of the comparison that the output voltage value of the ion balance sensor exceeds the other of the positive and negative set point voltage values.

10. A method according to claim 9 wherein the positive high voltage power supply has a steady state DC output, and the negative high voltage power supply switches between a high state and a low state, and step (d) switches the negative high voltage power supply to the high state when the ion balance sensor exceeds the positive set point voltage value, and step (e) switches the negative high voltage power supply to the low state when the ion balance sensor exceeds the negative set point voltage value.

11. A method according to claim 8 wherein the positive ion balance sensor set point voltage value is equal to, and opposite in polarity from, the negative ion balance sensor set point voltage value.

12. A method according to claim 11 wherein the midpoint between the positive and negative ion balance sensor set point voltage values is a voltage value that provides a balanced ion condition in the work space near the electrical ionizer.

13. A method according to claim 8 wherein the positive and negative high voltage power supplies both switch between a high state and a low state, wherein step (d) further comprises switching the other of the switchable high voltage power supplies to a low state when it is detected as a result of the comparison that the output voltage value of the ion balance sensor exceeds one of the positive and negative set point voltage values; and wherein step (e) further comprises switching the other of the switchable high voltage power supplies to a high state when it is detected as a result of the comparison that the output voltage value of the ion balance sensor exceeds the other of the positive and negative set point voltage values.

14. A method according to claim 8 wherein the high state provides fully switched on input power to the at least one switchable high voltage power supply, and the low state provides fully switched off input power to the at least one switchable high voltage power supply.

15. A method according to claim 8 wherein the high state provides a first input voltage to the at least one switchable high voltage power supply, and the low state provides a second input voltage lower than the first input voltage to the at least one switchable high voltage power supply.

16. A method of balancing positive and negative ion output in an electrical ionizer having (i) positive and negative ion emitters, and (ii) positive and negative high voltage power supplies associated with the respective positive and negative ion emitters, at least one of the positive and negative high voltage power supplies switching between a high state and a low state, the method comprising:

(a) during operation of the electrical ionizer, measuring the actual ion balance in the work space near the electrical ionizer as a voltage value; and (b) switching one of the switchable high voltage power supplies to a high state when the measured actual ion balance exceeds a zero voltage value in a first direction by a first predetermined amount; and (c) switching the one of the switchable high voltage power supplies to a low state when the measured actual ion balance exceeds a zero voltage value in a second direction by a second predetermined amount, the second direction being opposite of the first direction.

17. A method according to claim 16 wherein one of the positive and negative high voltage power supplies has a steady state DC output, and the other of the positive and negative high voltage power supplies switches between a high state and a low state, wherein step (b) comprises switching the switchable high voltage power supply to a high state when the measured actual ion balance exceeds a zero voltage value in a first direction by a first predetermined amount; and wherein step (c) comprises switching the switchable high voltage power supply to a low state when the measured actual ion balance exceeds a zero voltage value in a second direction by a second predetermined amount.

18. A method according to claim 17 wherein the positive high voltage power supply has a steady state DC output, and the negative high voltage power supply switches between a high state and a low state, and steps (b) and (c) switch the negative high voltage power supply to the high and low states.

19. A method according to claim 16 wherein the positive and negative high voltage power supplies both switch between a high state and a low state, wherein step (b) further comprises switching the other of the switchable high voltage power supplies to a low state when the measured actual ion balance exceeds a zero voltage value in a first direction by a first predetermined amount; and wherein step (c) further comprises switching the other of the switchable high voltage power supplies to a high state when the measured actual ion balance exceeds a zero voltage value in a second direction by a second predetermined amount.

20. A method according to claim 16 wherein the high state provides fully switched on input power to the at least one switchable high voltage power supply, and the low state provides fully switched off input power to the at least one switchable high voltage power supply.

21. A method according to claim 16 wherein the high state provides a first input voltage to the at least one switchable high voltage power supply, and the low state provides a second input voltage lower than the first input voltage to the at least one switchable high voltage power supply.

22. A method according to claim 16 wherein the first and second predetermined values are identical.

23. An apparatus for balancing positive and negative ion output in an electrical ionizer having (i) positive and negative ion emitters, and (ii) positive and negative high voltage power supplies associated with the respective positive and negative ion emitters, at least one of the positive and negative high voltage power supplies switching between a high state and a low state, the apparatus comprising:

(a) an ion balance sensor located close to the ion emitters, the ion balance sensor outputting a voltage value;

(b) a memory for storing an ion balance sensor set point voltage value, the voltage value being set to provide a balanced ion condition in the work space near the electrical ionizer;

(c) a processor which compares the output voltage value of the ion balance sensor with the set point voltage value during operation of the electrical ionizer; and (d) a switch controller connected at an input to an output of the processor and connected at an output to at least one of the switchable high voltage power supplies, the processor causing the switch controller to switch one of the switchable high voltage power supplies to a high state when it is detected as a result of the comparison that the output voltage value of the ion balance sensor exceeds the set point voltage value in a first direction by a first predetermined amount, and to switch the one of the switchable high voltage power supplies to a low state when it is detected as a result of the comparison that the output voltage value of the ion balance sensor exceeds the set point voltage value in a second direction by a second predetermined amount, the second direction being opposite of the first direction.

24. An apparatus according to claim 23 wherein one of the positive and negative high voltage power supplies has a steady state DC output, and the other of the positive and negative high voltage power supplies switches between a high state and a low state, wherein the processor causes the switch controller to switch the switchable high voltage power supply to a high state when it is detected as a result of the comparison that the output voltage value of the ion balance sensor exceeds the set point voltage value in a first direction by a first predetermined amount, and to switch the switchable high voltage power supply to a low state when it is detected as a result of the comparison that the output voltage value of the ion balance sensor exceeds the set point voltage value in a second direction by a second predetermined amount.

25. An apparatus according to claim 24 wherein the positive high voltage power supply has a steady state DC output, and the negative high voltage power supply switches between a high state and a low state, and the processor causes the switch controller to switch the negative high voltage power supply to the high and low states.

26. An apparatus according to claim 23 wherein the positive and negative high voltage power supplies both switch between a high state and a low state, wherein the processor causes the switch controller to switch the other of the switchable high voltage power supplies to a low state when it is detected as a result of the comparison that the output voltage value of the ion balance sensor exceeds the set point voltage value in a first direction by a first predetermined amount, and to switch the other of the switchable high voltage power supplies to a high state when it is detected as a result of the comparison that the output voltage value of the ion balance sensor exceeds the set point voltage value in a second direction by a second predetermined amount.

27. An apparatus according to claim 23 wherein the high state provides fully switched on input power to the at least one switchable high voltage power supply, and the low state provides fully switched off input voltage to the at least one switchable high voltage power supply.

28. An apparatus according to claim 23 wherein the high state provides a first input voltage to the at least one switchable high voltage power supply, and the low state provides a second input voltage lower than the first input voltage to the at least one switchable high voltage power supply.

29. An apparatus according to claim 23 wherein the first and second predetermined values are identical.

30. An apparatus for balancing positive and negative ion output in an electrical ionizer having (i) positive and negative ion emitters, and (ii) positive and negative high voltage power supplies associated with the respective positive and negative ion emitters, at least one of the positive and negative high voltage power supplies switching between a high state and a low state, the apparatus comprising:

(a) an ion balance sensor located close to the ion emitters, the ion balance sensor outputting a voltage value;

(b) a memory for storing a positive ion balance sensor set point voltage value and a negative ion balance sensor set point voltage value;

(c) a processor which compares the output voltage value of the ion balance sensor with the positive and negative set point voltage values during operation of the electrical ionizer; and (d) a switch controller connected at an input to an output of the processor and connected at an output to at least one of the switchable high voltage power supplies, the processor causing the switch controller to switch one of the switchable high voltage power supply to a high state when it is detected as a result of the comparison that the output voltage value of the ion balance sensor exceeds one of the positive and negative set point voltage values, and to switch the one of the switchable high voltage power supplies to a low state when it is detected as a result of the comparison that the output voltage value of the ion balance sensor exceeds the other of the positive and negative set point voltage values.

31. An apparatus according to claim 30 wherein one of the positive and negative high voltage power supplies has a steady state DC output, and the other of the positive and negative high voltage power supplies that switches between a high state and a low state, wherein the processor causes the switch controller to switch the switchable high voltage power supply to a high state when it is detected as a result of the comparison that the output voltage value of the ion balance sensor exceeds one of the positive and negative set point voltage values, and to switch the switchable high voltage power supplies to a low state when it is detected as a result of the comparison that the output voltage value of the ion balance sensor exceeds the other of the positive and negative set point voltage values.

32. An apparatus according to claim 31 wherein the positive high voltage power supply has a steady state DC output, and the negative high voltage power supply switches between a high state and a low state, and the processor causes the switch controller to switch the negative high voltage power supply to the high state when the ion balance sensor exceeds the positive set point voltage value, and to switch the negative high voltage power supply to the low state when the ion balance sensor exceeds the negative set point voltage value.

33. An apparatus according to claim 30 wherein the positive ion balance sensor set point voltage value is equal to, and opposite in polarity from, the negative ion balance sensor set point voltage value.

34. An apparatus according to claim 33 wherein the midpoint between the positive and negative ion balance sensor set point voltage values is a voltage value that provides a balanced ion condition in the work space near the electrical ionizer.

35. An apparatus according to claim 30 wherein the positive and negative high voltage power supplies both switch between a high state and a low state, wherein the processor causes the switch controller to switch the other of the switchable high voltage power supplies to a low state when it is detected as a result of the comparison that the output voltage value of the ion balance sensor exceeds one of the positive and negative set point voltage values, and to switch the other of the switchable high voltage power supplies to a high state when it is detected as a result of the comparison that the output voltage value of the ion balance sensor exceeds the other of the positive and negative set point voltage values.

36. An apparatus according to claim 30 wherein the high state provides fully switched on input power to the at least one switchable high voltage power supply, and the low state provides fully switched off input power to the at least one switchable high voltage power supply.

37. An apparatus according to claim 30 wherein the high state provides a first input voltage to the at least one switchable high voltage power supply, and the low state provides a second input voltage lower than the first input voltage to the at least one switchable high voltage power supply.

38. An apparatus for balancing positive and negative ion output in an electrical ionizer having (i) positive and negative ion emitters, and (ii) positive and negative high voltage power supplies associated with the respective positive and negative ion emitters, at least one of the positive and negative high voltage power supplies switching between a high state and a low state, the apparatus comprising:

(a) a charged plate monitor which measures the actual ion balance in the work space near the electrical ionizer as a voltage value during operation of the electrical ionizer, (b) a processor having an input which receives the voltage value from the charged plate monitor; and (c) a switch controller connected at an input to an output of the processor and connected at an output to at least one of the switchable high voltage power supplies, the processor causing the switch controller to switch one of the switchable high voltage power supplies to a high state when the measured actual ion balance exceeds a zero voltage value in a first direction by a first predetermined amount, and to switch the one of the switchable high voltage power supplies to a low state when the measured actual ion balance exceeds a zero voltage value in a second direction by a second predetermined amount, the second direction being opposite of the first direction.

39. An apparatus according to claim 38 wherein one of the positive and negative high voltage power supplies has a steady state DC output, and the other of the positive and negative high voltage power supplies switches between a high state and a low state, wherein the processor causes the switch controller to switch the switchable high voltage power supply to a high state when the measured actual ion balance exceeds a zero voltage value in a first direction by a first predetermined amount, and to switch the switchable high voltage power supply to a low state when the measured actual ion balance exceeds a zero voltage value in a second direction by a second predetermined amount.

40. An apparatus according to claim 39 wherein the positive high voltage power supply has a steady state DC output, and the negative high voltage power supply switches between a high state and a low state, and the processor causes the switch controller to switch the negative high voltage power supply to the high and low states.

41. An apparatus according to claim 38 wherein the positive and negative high voltage power supplies both switch between a high state and a low state, wherein the processor causes the switch controller to switch the other of the switchable high voltage power supplies to a low state when the measured actual ion balance exceeds a zero voltage value in a first direction by a first predetermined amount, and to switch the other of the switchable high voltage power supplies to a high state when the measured actual ion balance exceeds a zero voltage value in a second direction by a second predetermined amount.

42. An apparatus according to claim 38 wherein the high state provides fully switched on input power to the at least one switchable high voltage power supply, and the low state provides fully switched off input power to the at least one switchable high voltage power supply.

43. An apparatus according to claim 38 wherein the high state provides a first input voltage to the at least one switchable high voltage power supply, and the low state provides a second input voltage lower than the first input voltage to the at least one switchable high voltage power supply.

44. An apparatus according to claim 38 wherein the first and second predetermined values are identical.

* * * * *